US007458786B2

(12) United States Patent
Mac Donald

(10) Patent No.: US 7,458,786 B2
(45) Date of Patent: Dec. 2, 2008

(54) OIL WELL PUMPING UNIT AND METHOD THEREFOR

(76) Inventor: Robert George Mac Donald, 3500 Sahara La., Bakersfield, CA (US) 93313

( * ) Notice: Subject to any disclaimer, the term of this patent is extended or adjusted under 35 U.S.C. 154(b) by 390 days.

(21) Appl. No.: 11/073,339

(22) Filed: Mar. 4, 2005

(65) Prior Publication Data

US 2005/0196286 A1 Sep. 8, 2005

Related U.S. Application Data

(60) Provisional application No. 60/549,873, filed on Mar. 4, 2004.

(51) Int. Cl.
*F04B 17/00* (2006.01)
*F04B 35/00* (2006.01)
*F04B 9/08* (2006.01)

(52) U.S. Cl. ..... 417/328; 417/390; 417/904; 166/68; 166/69

(58) Field of Classification Search ..... 417/904, 417/328, 390; 166/68, 69
See application file for complete search history.

(56) References Cited

U.S. PATENT DOCUMENTS 1,207,824 A * 12/1916 Wendt ..... 417/329
3,405,605 A * 10/1968 Ross ..... 91/173
4,099,447 A * 7/1978 Ogles ..... 91/218
4,449,896 A * 5/1984 Klepper et al. ..... 417/399
4,474,002 A * 10/1984 Perry ..... 60/369
4,530,645 A * 7/1985 Whatley et al. ..... 417/399
4,534,168 A * 8/1985 Brantly ..... 60/369
5,089,124 A * 2/1992 Mahar et al. ..... 210/198.2
5,827,051 A * 10/1998 Smith ..... 417/375
5,997,181 A 12/1999 Stanley
6,585,049 B2 * 7/2003 Leniek, Sr. ..... 166/369
6,644,937 B2 * 11/2003 Han ..... 417/329

* cited by examiner

*Primary Examiner*—Devon Kramer
*Assistant Examiner*—Patrick Hamo
(74) *Attorney, Agent, or Firm*—Carr & Ferrell LLP

(57) ABSTRACT

An improved oil well pumping unit and method thereof configured for use on new or existing oil wells. The present invention is for mechanical operation of the subsurface pump and replaces existing mechanical pumping units. The present invention multiplies input purchased energy through mechanical links, pressurized fluid and/or gas, moving weights and counterweights and a control system in order to pump produced fluid through a new or existing conventional reciprocating oil well pump.

13 Claims, 3 Drawing Sheets

OIL WELL PUMPING UNIT AND METHOD THEREFOR

CROSS REFERENCE TO RELATED APPLICATIONS

This Application claims priority under 35 U.S.C. § 119(e) to provisional patent application Ser. No. 60/549,873 by the same and sole inventor, Robert George Mac Donald, titled "Oil Well Pumping Unit" and having a filing date of Mar. 4, 2004.

STATEMENT REGARDING FEDERALLY SPONSORED RESEARCH OR DEVELOPMENT

Not Applicable.

SEQUENCE LISTING OR PROGRAMS

Not Applicable.

DESCRIPTION OF ATTACHED APPENDIX

Not Applicable.

BACKGROUND OF THE INVENTION

1. Field of Invention

This invention relates to an improved oil well pumping unit and method thereof configured for use on new or existing oil wells. This invention is for mechanical operation of the subsurface pump and replaces existing mechanical pumping units.

2. Background of the Invention

Oil wells vary in depth from a few hundred feet to over 14,000 feet. Oil is lifted from these depths by a plunger which reciprocates within a pump barrel at the bottom of the well. The plunger is driven by a sucker rod or an interconnected series of sucker rods which extend down from the surface of the oil well to the plunger.

FIG. 1 shows the prior art representing a conventional pump jack 10 for driving the sucker rod of an oil well pump. Pump jack 10 generally comprises a walking beam 12 which is connected through a polished rod 14 to an in-hole sucker rod (not shown). Walking beam 12 is pivotally supported at an intermediate position along its length by a Samson post 16, which is in turn mounted to a base frame 18. A drive crank system 20 is also mounted to base frame 18. Base frame 18 is mounted to a concrete base to rigidly locate all components relative to the oil well.

Drive crank system 20 has a rotating eccentric crank arm 24. Crank arm 24 is driven at a constant speed by an electric or gas motor in combination with a gearbox or reducer, generally designated by the reference numeral 26. Eccentric crank arm 24 rotates about a horizontal axis.

Walking beam 12 has a driven end 30 and a working end 32 on either side of its pivotal connection to Samson post 16. One or more pitman arms 34 extend from driven end 30 to a crank pin 35 positioned intermediately along outwardly extending eccentric crank arm 24. Rotation of crank arm 24 is translated by pitman arms 34 into vertical oscillation of the walking beam's driven end 30 and corresponding oscillation of working end 32.

Working end 32 of walking beam 12 has an arcuate cable track or horsehead 36. A cable 38 is connected to the top of the cable track 36. Cable 38 extends downwardly along the cable track 36 and is connected at its lower end to polished rod 14.

Pivotal oscillation of walking beam 12 thus produces corresponding vertical oscillation of polished rod 14 and of the connected sucker rod. The arcuate shape of cable track 36 ensures that forces between working end 32 and polished rod 14 remain vertically aligned at all positions of walking beam 12.

The sucker rod of an oil well pump performs its work during an upward stroke, when oil is lifted from the well. No pumping is performed during the downward stroke of the sucker rod. Accordingly, a pump jack such as described above supplies force to a sucker rod primarily during its upward stroke. Relatively little force is produced on the downward stroke. To increase efficiency of a drive system counterbalance weights are utilized to store energy during the sucker rod downward stroke and to return that energy to assist in the sucker rod upward stroke.

In pump jack 10, counterbalance weights 40 are positioned at the outermost end of crank arm 24. Such weights could also be positioned on the driven end 30 of walking beam 12. However, a mechanical advantage is obtained by placing the weights outward along the crank arm from the pitman arm connection. During the downstroke of the sucker rod the driving motor must supply energy to raise weights 40 to the top of their stroke. During the sucker rod's upstroke, however, weights 40 assist the motor and gearbox since the outward end of crank arm 24 moves downward while the sucker rod moves upward. The peak energy required by the motor is therefore greatly reduced, allowing a smaller motor to be used with corresponding increases in efficiency.

Mechanical pump jacks such as described above have been used for many years and continue to be used nearly exclusively for driving oil well pumps. One reason for the popularity of such mechanical systems is their extreme simplicity. They do not involve valves, switches, or electronics and there are a minimum of moving parts. This simplicity results in reliability which is difficult to accomplish with more complex systems. Reliability is of utmost importance since oil well pumps are unattended for long periods, often being located in remote locations.

The very nature of sucker rod displacement created by a reciprocating pump jack is another apparent reason for its success. An oil well sucker rod is often over 14,000 feet long. While reciprocating, it must not only accelerate and decelerate itself, but also a 14,000 foot oil column. In addition, it must accelerate and decelerate oil within an above-surface production line, which can be as long as five miles. Forces caused by sudden acceleration of the sucker rod are therefore very significant. Any such sudden or undue acceleration can stretch and snap the sucker rod.

The pump jack described above minimizes acceleration and deceleration forces on the sucker rod by producing an approximately sinusoidal displacement at the polished rod. The sinusoidal displacement results from translation of rotary crank motion to linear motion at the polished rod. Such sinusoidal motion significantly reduces strain on the driven sucker rod.

SUMMARY OF THE INVENTION

The present invention relates to an improved oil well pumping unit and method thereof configured for use on new or existing oil wells. The present invention is for mechanical operation of the subsurface pump and replaces existing mechanical pumping units.

The present invention offers an oil well pumping unit wherein the cylinder may be pressurized with air, other gases, oil, water or other fluids or combinations thereof or other equivalent means for pressurizing one or more cylinders.

The present invention offers an oil well pumping unit wherein the cylinder may be replaced by mechanical devices such as screw drives, rack and pinion or worm gears or other equivalent devices.

The present invention offers an oil well pumping unit wherein the diameter of one or more cylinders can vary from one (1) inch to over six hundred (600) inches.

The present invention offers an oil well pumping unit wherein the cylinder operating pressure can vary from one (1) pound per square inch (PSI) to ten-thousand (10,000) pounds per square inch (PSI).

The present invention offers an oil well pumping unit wherein the external pump may be powered by electricity, gasoline, diesel or other combustible fuels or combination thereof generating from a fraction of a horsepower to over one-thousand (1,000) horsepower.

The present invention offers an oil well pumping unit wherein one or more counterweights per each fulcrum arm can be constructed of any one or combination of metals or equivalent means for weighting the fulcrum arm, including the use of fluid filled vessels or other dense materials.

The present invention offers an oil well pumping unit wherein the pivot points can be constructed of bearings or bearing material or other equivalent means for facilitating movement between the relevant component parts.

The present invention offers an oil well pumping unit that can be constructed primarily out of steel or other equivalent construction materials.

The present invention offers an oil well pumping unit that incorporates one or more traveling weights that can be mechanical, hydraulic, air, spring assisted or other equivalent means for generating the invention's mechanical advantage as described herein.

The present invention offers an oil well pumping unit that multiplies input purchased energy via a series of mechanical links, pressurized fluid and/or gas, moving weights and counterweights and a control system to pump produced fluid through a new or existing conventional reciprocating oil well pump.

The present invention offers an oil well pumping unit that can accommodate a variety of structural designs and environmental factors.

The present invention offers an oil well pumping unit wherein the power, energy or lifting output is field adjustable.

The present invention offers an oil well pumping unit wherein the cylinder pressure can be changed to compensate for increased or decreased columnar loads.

The present invention offers an oil well pumping unit wherein the reciprocating stroke speed and stroke length are adjustable.

The present invention offers an oil well pumping unit wherein the low purchased energy input increases efficiency and decreases operating costs.

The present invention offers an oil well pumping unit wherein the simplicity of the design allows for low maintenance costs, a minimum number of moving parts and extreme reliability.

REFERENCE NUMERALS FOR FIGS. 2-3.

Fixed counterweight 1; Fulcrum arm 2; Samson post and hydraulic reservoir 3; Cylinder link 4; Belt and/or chain attachment arm 5; Cylinder 6; Traveling weight 7; Belt and/or chain 8; Structure base 9; Conventional well pump hook-up 10; Load beam 11; Latch landing platform 12; Accelerator/energy transfer point 13; Ram 14; Fulcrum arm/Load Beam pivot point 15; Cylinder link/Fulcrum arm pivot point 16; Belt and/or chain attachment pivot point 17; Roller or pulley or sprocket 18; Fulcrum arm/Samson post pivot point 19; Crown pulley 20; Hose or pipe 21; External pump 22; Columnar load including sucker rod, polish rod and fluid 23; Traveling weight stop 24; Traveling weight latch 25.

DETAILED DESCRIPTION OF THE DRAWINGS

Figure 1:
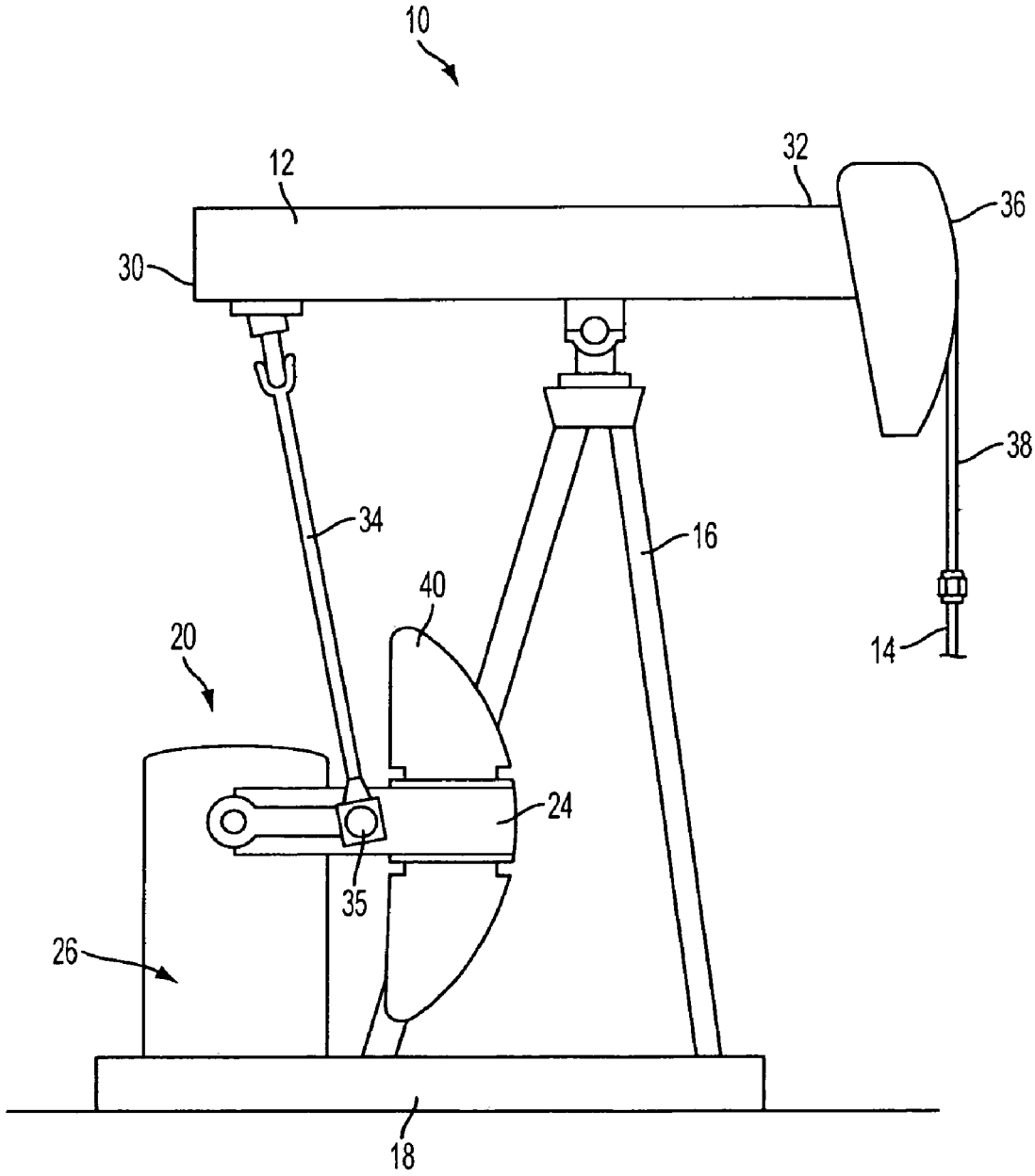
FIG. 1 PRIOR ART
FIG. 1 shows the prior art representing a conventional pump jack for driving the sucker rod of an oil well pump.
Figure 2:
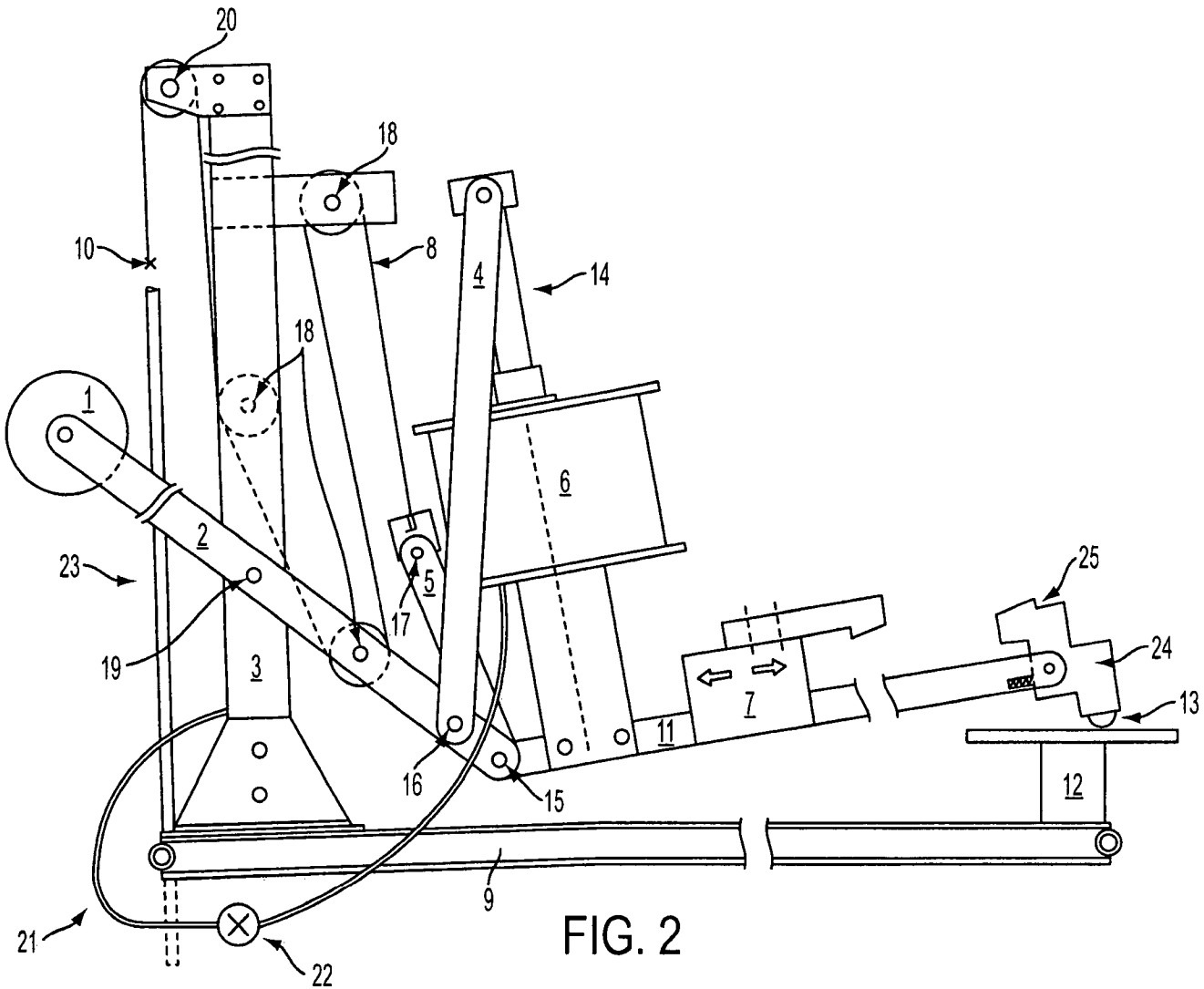
FIG. 2 is a front view of one preferred embodiment of the present invention showing the pump cycle with respect to cylinder pressurization and the first oil discharged during the pump cycle.
Figure 3:
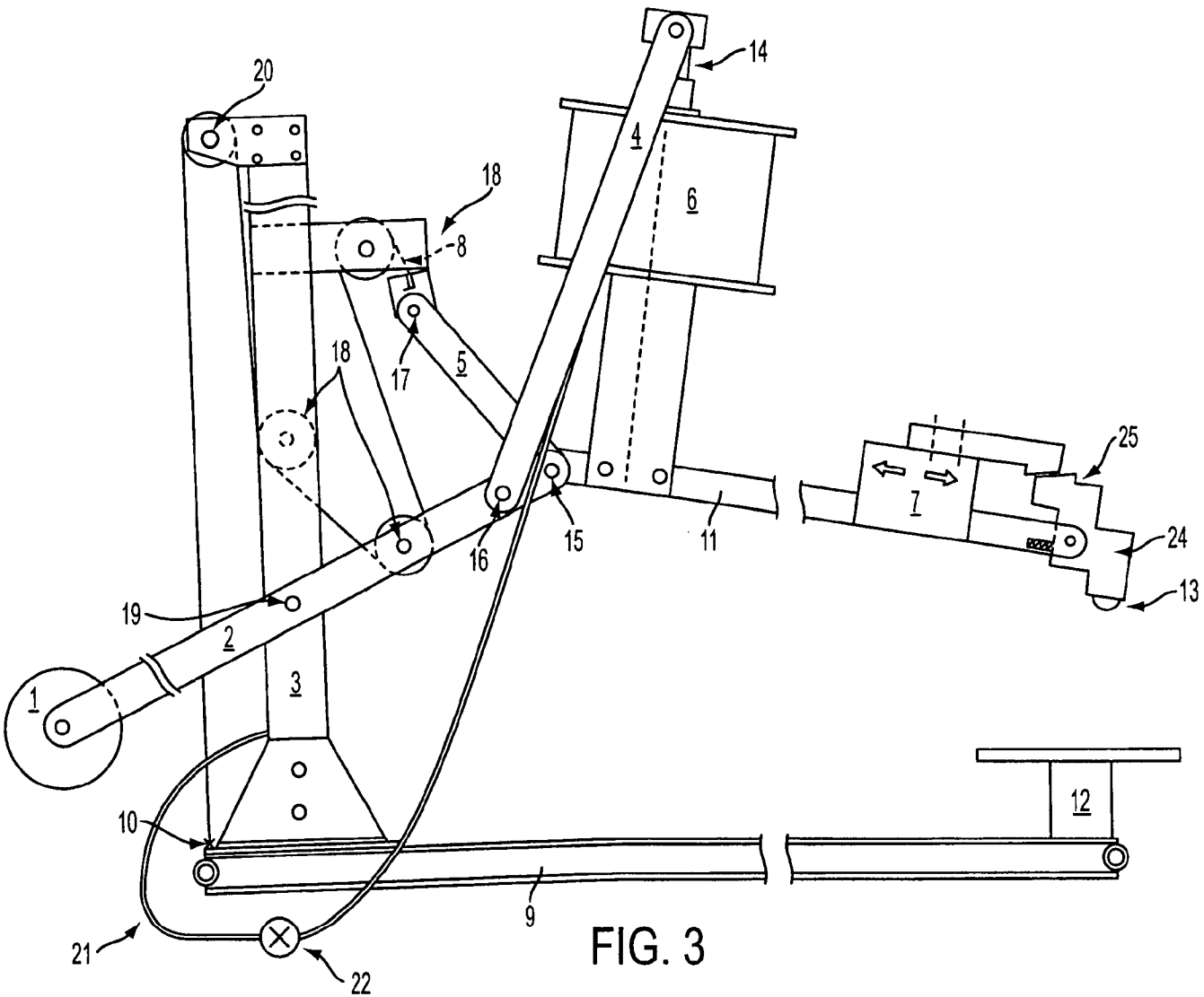
FIG. 3 is a front view of one preferred embodiment of the present invention showing the pump cycle with respect to cylinder depressurization.

FIGS. 2-3 illustrate one preferred embodiment of the present invention.

FIG. 2 illustrates the pump cycle with respect to cylinder pressurization and the first oil discharge from the columnar load during the pump cycle.

Many, if not most of the processes described herein will be synchronized, controlled and monitored by one or more program logic controllers in conjunction with solenoid and metering valves, all of which are currently available and known by those having ordinary skill in the relevant art. The process begins by the transfer of water or other means for pressurizing at least one cylinder 6 from at least one Samson post 3. Virtually any height of Samson post may be used. A preferred embodiment of the invention utilizes two forty (40) foot tall enclosed Samson posts made of steel or other material having similar characteristics, especially with respect to strength, affordability, malleability and water and/or gas resiliency. A preferred embodiment features each Samson post with internal dimensions of approximately four feet by four feet [sixteen (16) square feet] and is capable of holding water under pressure or other means for pressurizing the cylinder 6.

The water or other means for pressurizing the cylinder 6 is contained within at least one Samson post 3. The water or other means for pressurizing the cylinder 6, when released from Samson post 3, will exert pressure through a hose or pipe or other means for fluid or gas travel 21, said pressure enabling the travel of the water or other means for pressurizing the cylinder 6 to and through an external pump 22 and then to the bottom of the cylinder 6. A preferred embodiment utilizes approximately the bottom six feet in height of the forty feet in height of water from at least one Samson post 3 to pressurize the cylinder 6. External pump 22 powered by purchased energy will supplement the pressure of the water or other means for pressurizing the cylinder 6. The pressure provided by external pump 22 is in addition to the pressure provided by the pressure originating from within Samson post 3. The external pump 22 will also provide the means by which the water or other means for pressurizing the cylinder 6 is transferred back to at least one Samson post 3 from the cylinder 6 when the cylinder is depressurized. A preferred embodiment uses a 20 horsepower fuel, gas or electric motor means for powering the external pump 22. A preferred embodiment of the external pump 22 will contribute sufficient pressure in addition to the pressure originating from within the Samson post 3 to result in no more than 20 pounds per square inch (PSI) to the cylinder 6. The water or other means for pressurizing cylinder 6 will travel through the external pump 22 by way of a hose or pipe or other means for fluid or gas travel 21 into the bottom of the cylinder 6.

A preferred embodiment of the present invention will utilize a cylinder of approximately forty-eight (48) inches in diameter and having a volume of eighteen hundred (1800) square inches, which will receive water or other means for pressurizing the cylinder at a pressure of approximately twenty (20) pounds per square inch (PSI), resulting in 36,000 lbs of energy or lifting power that can be applied to lifting the columnar load 23 as described herein.

As the cylinder 6 is pressurized, the force of the water or other means for pressurizing the cylinder forces or pushes against the bottom of the cylinder. This force or push causes the pivot point 15 formed at the intersection of the fulcrum arm 2 and load beam 11 to go down, eventually to its lowest point of vertical travel. As the cylinder becomes pressurized with water or other means for pressurizing the cylinder, the angle formed by the fulcrum arm 2 and load beam 11 will form a shape approximating the letter "L" with the inherent right angle somewhat flattened with the elongated portion of the letter (representing the load beam 11) in a horizontal position with the bottom portion of the letter (representing the fulcrum arm 2) rising into the air.

During cylinder pressurization, the pivot point 15 formed at the intersection of the fulcrum arm 2 and load beam 11 will fall below the height of the traveling weight 7 positioned at or near the traveling weight stop 24. The decline of the load beam 11 will cause the traveling weight 7 to descend along the load beam 11 toward the cylinder 6. The traveling weight can be made up of virtually any material sufficient to provide the requisite weight. A preferred embodiment of the traveling weight utilizes either a steel or concrete slab on rollers. The forward motion of the traveling weight 7 along the load beam 11 creates the invention's unique mechanical advantage, having energy approximated by the weight of the traveling weight 7 times the distanced traveled by the traveling weight 7 along the load beam 11. This energy or mechanical advantage, supplements the energy supplied by the cylinder 6 to lifting the columnar load 23, thus reducing the need for other forms of force, energy or power that would otherwise be supplied by purchased input energy coming through an external pump 22 or other conventional or non-conventional means to the cylinder 6 or directly applied to lifting the columnar load 23. When the traveling weight 7 has reached the end of its travel along the load beam 11 toward the cylinder 6, it is in a position known as the fully retracted or negative state. In the fully retracted or negative state, each counterweight 1 connected to the end of the corresponding fulcrum arm 2 is fully elevated at the highest point of its vertical travel, with each fulcrum arm 2 forming an upward angle as measured from pivot point 19 at the intersection of each fulcrum arm 2 with the corresponding Samson post 3 to which the fulcrum arm 2 is pivotally connected. At or near this time, the columnar load 23 will have been lifted to allow the discharge of oil solution. The ram 14 will be at a heightened extension out of the cylinder 6 and the top portion of ram 14 will be positioned against the transverse portion of the cylinder link 4. At the same time, the cylinder 6 will be at or near its lowest vertical position, remaining non-pivotally affixed and mounted to the load beam 11.

Notwithstanding sucker rod stretch, which is a function of the age, weight, strength, environmental conditions and other factors influencing the sucker rod, the sucker rod travel or stroke (distance traveled down by the sucker rod) can be approximated by the movement of the conventional well pump hook-up 10. The present invention offers a sucker rod stroke that can be varied to accommodate the needs of virtually any well. The sucker rod stroke can vary from approximately one (1) to over twenty-five (25) times the distance traveled by the ram 14 out of the cylinder 6 during pressurization.

As the ram 14 moves out of the cylinder 6 in response to cylinder pressurization, the cylinder 6 pushes down against the load beam 11 to which the cylinder is non-pivotally mounted. The belt and/or chain attachment arm 5 is pivotally connected at pivot point 15, which is also the pivot point for the fulcrum arm 2 and load beam 11. The movement of the load beam 11 upon pivot point 15 as caused by the movement of the cylinder 6 during pressurization is approximated by the movement of the ram 14. Accordingly, a proportionate amount of movement as represented by the movement of the ram 14 also occurs in the belt and/or chain attachment arm 5. The belt and/or chain attachment arm 5 is pivotally connected at pivot point 17 to a belt and/or chain 8. Belt and/or chain 8 is attached to the conventional well pump hook-up 10. By varying the number of roller or pulley or sprocket(s) 18 used, in which the belt and/or chain 8 is wrapped or looped around and/or through, the present invention offers a sucker rod stroke that can be varied to accommodate the needs of virtually any well. Further, use of the roller or pulley or sprocket(s) 18 are optional and the belt and/or chain 8 may be directly wrapped or looped around and/or through the crown pulley 20 to the conventional well pump hook-up 10.

FIG. 3 illustrates the pump cycle with respect to cylinder 6 depressurization.

During depressurization, ram 14 will begin to substantially withdraw within the cylinder 6. As the cylinder 6 is partially depressurized, the combined weight of each counterweight 1 and the columnar load 23 will overcome (due in large part to the traveling weight 7 being in the retracted or negative position) the combined weight of all movable components at and behind pivot point 19, which is located at the intersection of each fulcrum arm 2 and associated Samson post 3. Each counterweight 1 will exert a downward pulling force on each fulcrum arm 2 to which each counterweight 1 is connected. The pivot point 15 at the intersection of the load beam 11 and fulcrum arm 2 will travel vertically upward. The load beam 11 will initially follow the upward travel of pivot point 15, with the load beam being in a relatively horizontal position and suspended above the ground. As the depressurization of the cylinder 6 continues, the far end of the load beam 11 located at or near the traveling weight stop 24 will decline from the vertically elevated pivot point 15. At or near this time, the traveling weight 7 begins to descend toward the traveling weight stop 24 at or near the far end of the load beam 11. In a synchronized fashion occurring at or near the same time, the traveling weight 7 will achieve its optimal distance of travel away from the cylinder 6 and the cylinder 6 will achieve its optimal level of depressurization. Traveling weight 7 will connect by traveling weight latch 25 to the traveling weight stop 24. At or near the time cylinder 6 achieves its optimal level of depressurization, the cylinder will be pressurized from the Samson post as described above. Cylinder pressurization will result in each counterweight 1 on each fulcrum arm 2 (the counterweighted fulcrum arm) and the far end of the load beam 11 located at or near the traveling weight stop 24 to pivot or swing upward, while pivot point 15 at the intersection of the load beam 11 and fulcrum arm 2 descends. Each fulcrum arm 2 will have an upward incline with respect to pivot points 15 and 19. Meanwhile, the load beam 11 will have an upward incline with respect to pivot point 15. Collectively each fulcrum arm 2 and load beam 11 will form a shape loosely approximating a flattened letter "V." While the cylinder 6 maintains its relatively constant pressure, and the angle loosely approximating the aforesaid flattened letter "V" is maintained between each fulcrum arm and the load beam, the weight represented by the traveling weight 7 will exert a strong countering force or pressure upon each fulcrum arm 2, resulting in the pulling of the columnar load 23 to an elevated vertical position to allow the discharge of the oil solution. The end of load beam 11 will complete its descent upon the latch landing platform 12 and the accelerator/energy transfer point 13 will facilitate the transfer of energy or momentum to the end of the load beam 11 to unlatch the traveling weight 7 from the traveling weight stop 24 and to initiate the next cycle, repeating the process described herein.

I claim:

1. An oil well pump comprising:

a fluid reservoir in fluid communication with a first side of a pump;

a cylinder having a top side, a bottom side and an internal chamber, the internal chamber of the cylinder in fluid communication with a second side of the pump;

a cylinder mount attached to the bottom side of the cylinder;

a load beam having a first end and a second end, and wherein the cylinder mount is attached between the first end and the second end of the load beam;

a fulcrum arm having a first end, a second end and a pivot point, the pivot point positioned between the first end and the second end, and wherein the first end of the fulcrum arm is pivotally attached to the first end of the load beam;

a vertical post having a first end and a second end, and wherein the fulcrum arm is pivotally attached to the vertical post between the first end and the second end of the vertical post at the pivot point of the fulcrum arm;

a cylinder link having a first end and a second end, the first end of the cylinder link pivotally attached between the first end of the fulcrum arm and the pivot point of the fulcrum arm;

a ram having a first end and a second end, the first end of the ram pivotally attached to the second end of the cylinder link and the second end of the ram positioned through the top side of the cylinder to move into and out of the internal chamber of the cylinder without detaching from the top side of the cylinder; and a belt or chain coupled to near or at the first end of the fulcrum arm.

2. The oil well pump of claim 1, the oil well pump further comprising:

a travelling weight configured to travel along the load beam between the cylinder mount and near the second end of the load beam.

3. The oil well pump of claim 1, wherein the vertical post includes the fluid reservoir.

4. The oil well pump of claim 3, wherein the vertical post comprises a samson post.

5. The oil well pump of claim 1, the oil well pump further comprising:

a pulley or sprocket attached to the fulcrum arm between the pivot point and the first end of the cylinder link.

6. The oil well pump of claim 1, the oil well pump further comprising:

a pulley or sprocket attached on or near the vertical post.

7. The oil well pump of claim 1, the oil well pump further comprising:

a columnar load attached to the belt or chain.

8. The oil well pump of claim 1, the oil well pump further comprising:

a columnar load including a sucker rod, the columnar load attached to the belt or chain;

a first pulley or sprocket attached to the fulcrum arm between the pivot point and the first end of the cylinder link;

a second pulley or sprocket attached on or near the vertical post; and wherein the belt or chain engages the first and second pulleys or sprockets.

9. The oil well pump of claim 8, wherein a ratio of a first distance travelled by the sucker rod relative to a second distance travelled by the ram out of the top side of the cylinder is in a range of about 5 to 1.

10. The oil well pump of claim 9, wherein the ratio depends upon a number of pulleys or sprockets used.

11. The oil well pump of claim 9, wherein the ratio depends upon a type of pulley or sprocket used.

12. The oil well pump of claim 1 further comprising a counterweight attached to the second end of the fulcrum arm.

13. The oil well pump of claim 1, wherein the belt or chain is coupled near the first end of the fulcrum arm by an attachment arm.

* * * * *